United States Patent [19]

Djordjevic et al.

[11] Patent Number: 4,526,146

[45] Date of Patent: Jul. 2, 1985

[54] FUEL INJECTION PUMP

[75] Inventors: Ilija Djordjevic, Windsor, Conn.; Franz Eheim, Stuttgart, Fed. Rep. of Germany

[73] Assignee: Robert Bosch GmbH, Stuttgart, Fed. Rep. of Germany

[21] Appl. No.: 544,186

[22] Filed: Oct. 21, 1983

[30] Foreign Application Priority Data

Nov. 24, 1982 [DE] Fed. Rep. of Germany ..... 3243349

[51] Int. Cl.[3] ..... F02D 31/00

[52] U.S. Cl. ..... 123/357; 123/367; 123/503

[58] Field of Search ..... 123/367, 357–359, 123/382, 383, 387, 503

[56] References Cited

U.S. PATENT DOCUMENTS

| | | | |
|---|---|---|---|
| 2,195,927 | 4/1940 | Hurst et al. | 123/357 |
| 3,815,564 | 6/1974 | Suda et al. | 123/501 |
| 3,871,344 | 3/1975 | Pigeroulet et al. | 123/367 |
| 4,170,976 | 10/1979 | Eckert et al. | 123/387 |
| 4,243,004 | 1/1981 | Ritter et al. | 123/367 |
| 4,343,274 | 8/1982 | Butscher | 123/358 |
| 4,384,560 | 5/1983 | Jager et al. | 123/387 |
| 4,432,327 | 2/1984 | Salzgeber | 123/501 |

FOREIGN PATENT DOCUMENTS

| | | | |
|---|---|---|---|
| 138425 | 10/1981 | Japan | 123/358 |
| 28827 | 2/1982 | Japan | 123/367 |

*Primary Examiner*—Magdalen Y. C. Moy
*Attorney, Agent, or Firm*—Edwin E. Greigg

[57] ABSTRACT

An adjusting device in a fuel injection pump including a pivotable lever with a stop on one end which limits the movement of a quantity adjusting device counter to a spring force, a stepping motor including an adjusting device which actuates said lever for adjusting said stop which limits movement of the quantity adjusting device.

11 Claims, 7 Drawing Figures

Fig. 2
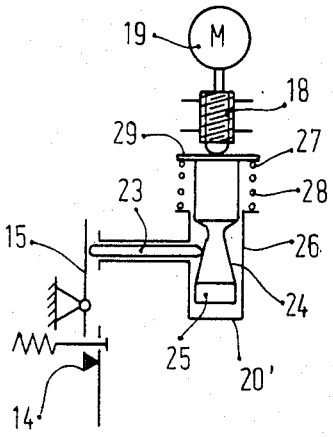
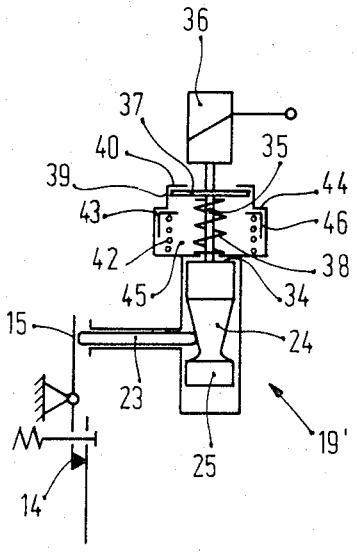
Fig. 3
Fig. 5
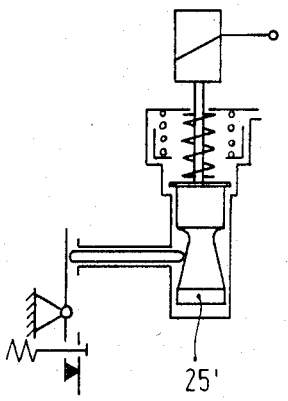

FUEL INJECTION PUMP

BACKGROUND OF THE INVENTION

The invention is based on a fuel injection pump having an adjusting device as generally defined.

In a known adjusting device of this kind (German Offenlegungsschrift No. 29 08 235), a full-load stop for a quantity adjusting device of a fuel injection pump is set by a stepping motor and the quantity adjusting device is actuated by a centrifugal governor, in cooperating with a load lever as already set forth in existing conventional fuel injection pumps. The stepping motor acts directly upon the stop and must be adjusted as needed counter to the force of the regulating spring. To this end, substantial adjusting forces must be exerted, which is disadvantageous, and furthermore the danger exists that the stepping motor may not be able to execute each of its adjusting increments. Especially if the position of the stop is to be determined in accordance with a control value, it is important for such a stepping motor to be assured of executing all its increments, or else, as provided in the known device, a feedback element for the position of the stop is required. This necessitates substantial additional expense, however, in order to attain the advantage offered by the stepping motor and its mode of operation; that is, the terminal position of a stop adjusted thereby is the product of the number of adjusting increments. The advantage of using a stepping motor, i.e., that feedback is not necessary for precise adjusting processes, would be lost after all because feedback is becoming necessary in the state of the art.

OBJECT AND SUMMARY OF THE INVENTION

The fuel injection pump according to the invention has the advantage over the prior art that the adjusting moment is reduced substantially, thereby substantially lessening the danger that incrementing errors may occur and meaning that the adjusting device can operate without continuous feedback. By means of the provisions set forth herein, advantageous embodiments for reducing the forces exerted by the quantity adjusting member upon the stepping motor are defined. Especially because of the provision that the stepping motor first returns to a reference point before each new adjustment of the stop, and the new control value is established from this reference point, it is assured that incrementing errors in the adjustment cannot have longlasting influence beyond a relatively long operating range of the fuel injection pump.

Embodying the stepping motor as set forth herein is particularly advantageous; here the adjusting increments are fixed by pre-stressed springs. With this device reliable and precise adjustment points for the adjustable stop are obtained, albeit on a relatively coarse-scale grid.

In a further advantageous embodiment, a spindle driven by the stepping motor may be provided in order to further reduce the adjusting forces that must be brought to bear by the stepping motor; the speed of revolution of the spindle can be limited by at least one drag member, which cooperates with a fixed stop. By means of one or more of such drag members, the adjusting path of the stepping motor can advantageously be lengthened, thereby attaining higher resolution.

The invention will be better understood and further objects and advantages thereof will become more apparent from the ensuing detailed description of seven preferred embodiments taken in conjunction with the drawings.

BRIEF DESCRIPTION OF THE DRAWINGS

FIG. 2 shows a second exemplary embodiment of the invention having a stepping motor which adjusts a cone, the scanning point of which is transmitted to the flexing member;

FIG. 3 shows a third exemplary embodiment having a linear stepping motor embodied by a pushing magnet;

FIG. 5 shows a second variant of the exemplary embodiment of FIG. 3;

DESCRIPTION OF THE PREFERRED EMBODIMENTS

Figure 1:
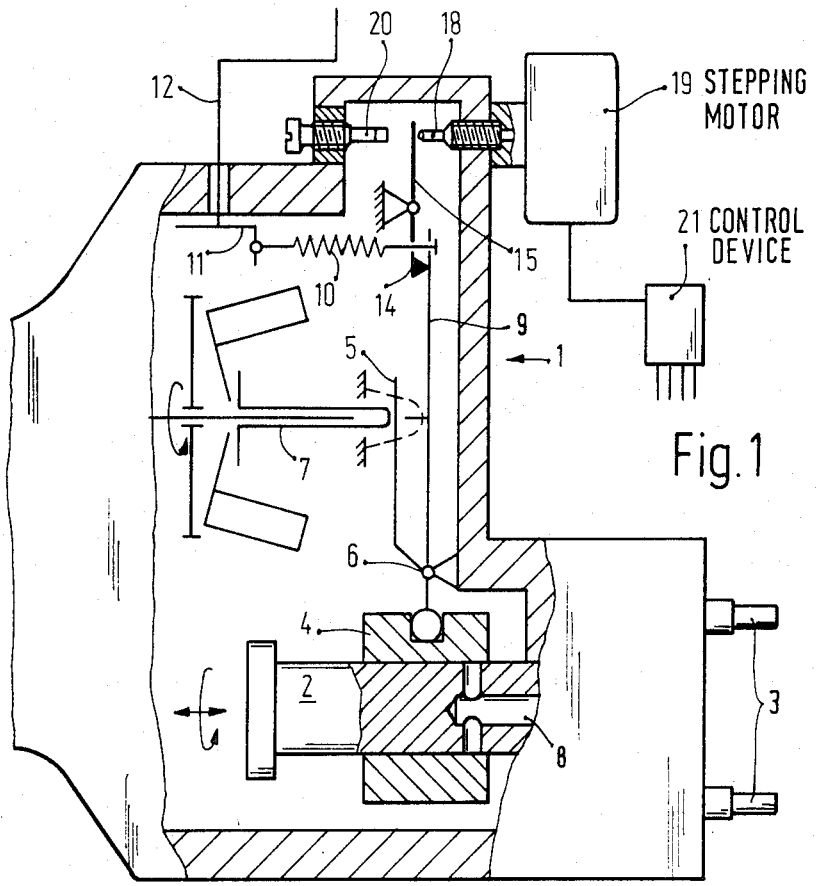
FIG. 1 shows a first exemplary embodiment having a stepping motor acting upon a flexing member.

FIG. 1 shows a partial schematic of a fuel injection pump 1 of the distributor-pump type, shown in simplified form and in partial section. Such pumps have, as shown, a pump piston 2 which simultaneously reciprocates and rotates, which upon its rotation opens up various fuel outlets 3 for supplying fuel injection locations of the associated internal combustion engine. The injection quantity is controlled in a known manner by an annular slide 4 acting as the quantity adjusting member, the upper edge of which controls a relief conduit 8 of the pump work chamber (not shown). The injection of fuel is terminated in a known manner by the opening up of this relief conduit 8.

The annular slide 4 is coupled with a dual-armed adjusting lever 5, which is pivotable about a shaft 6 fixed to the housing and which is engaged, at the end of the other arm, by an rpm transducer 7, shown in simplified form. This rpm transducer may be embodied as a centrifugal governor, which is driven in synchronism with the pump rpm and acts with an rpm-dependent force upon the adjusting lever 5.

The adjusting lever 5 can be moved by the rpm transducer 7 until it rests against a drag lever 9, which as a one-armed lever is pivotable about the shaft 6 of the adjusting lever. A regulating spring 10 is coupled to the end of the drag lever 9, and its initial stress is variable in a known manner by a cam 11, which is actuatable via a load lever 12 that is arbitrarily adjustable from outside the fuel injection pump.

The pivoting range of the drag lever 9 counter to the operating direction of the rpm transducer and in the directin toward the regulating spring 10 is limitable by an adjustable stop 14. This stop is located on the end of one lever arm of a flexing member 15, which is supported by and attached to the housing. The other end of the flexing member 15 is engaged by an adjusting device 18 of a stepping motor 14 by means of which the stop 14 is adjustable. The adjusting range of the adjusting member 18 is limitable by an adjustable stop 20, which is embodied by way of example in the form of a screw passing through the pump housing wall and capable of being turned from outside the pump. The stepping motor 19 is controlled by a control device 21, which emits counted adjusting increments to the stepping motor in accordance with a control value formed from operating parameters. In an advantageous manner, in order to make the new adjustment reliable, the adjusting device 18 can be moved as far as the adjustable stop 20 before each establishment of a new control value, and then brought to the desired terminal position by moving a number of increments corresponding to the control value then to be established. By the use of the flexing member 15, the adjusting forces which must be exerted by the stepping motor 19 to adjust the stop 14 counter to the force of the regulating spring 10 are reduced. Both a linear and a rotary stepping motor can be used; if a rotary stepping motor is used, the shaft of the stepping motor can drive a threaded spindle, acting as the adjusting device; as a result, the adjusting forces which the stepping motor has to overcome can be still further reduced substantially. If when an adjustment becomes necessary the adjusting device 18 together with the lever arm of the flexing member 15 moves to meet the adjustable stop 20, then upon contact on the stop 20 a signal is released, by which the new control value, stored in the control device, is called up from memory, causing the adjusting member to be moved into the desired new position.

FIG. 2 shows schematically a variant of the exemplary embodiment of FIG. 1, where the flexing member 15 is at first acted upon by a scanning pin 23 guided in the housing of the injection pump; the scanning pin 23 always rests on a contour 24, which is the jacket face of a body 25 that is displaceable transversely with respect to the scanning pin 23. The contour 24 is embodied in conical form and the body 25 has the basic shape of a cylindrical bolt, which is displaceably supported in a cylinder 26. A spring plate 27 is disposed on one end face of the body 25, and a restoring spring 28 is fastened between the spring plate 27 and the housing. The end face 29 of the body 25 toward the spring plate 27 is acted upon coaxially by the adjusting device 18 of a stepping motor 19. As a result of this disposition, an additional reduction of the forces required to adjust the stop 14 is attained, the extent depending upon the conical angle of the conical contour 24. The connection between the adjusting device 18 and the body 25 may be established either by positive engagement counter to the force of the restoring spring 28 or by a shape-dictated positive engagement, for instance via a threaded spindle.

FIG. 3 shows an exemplary embodiment which is substantially identical in structure to that of FIG. 2, having a scanning pin 23, which is disposed between the flexing adjustment member 15 and the conical contour 24 of a displaceable body 25 and is displaced in accordance with the varying radius of the contour 24 upon a longitudinal displacement of the body 24 and simultaneously adjusts the stop 14 on the flexing member 15. The body 25 is connected at one end face 34 with an actuation bolt 35, which is connected with the armature of an adjusting magnet 36 and has a spring plate 37, and a stop attached to the housing between which a first restoring spring is fastened. The spring plate 37 is displaceable inside a cylindrical guide 39 coaxially together with the body 25, its axial mobility being defined by a stop 40, subject to the force of the first restoring spring 38. A second restoring spring 42 is disposed coaxailly with the first restoring spring 38 and likewise is supported at one end on the housing and on the other end is supported on a second spring plate 43, which in the outset position comes to rest, under the influence of the second restoring spring 42, on a stop 44 attached to the housing. The second spring plate 43 has a central opening, the inside diameter of which is smaller than the outside diameter of the first spring plate 37, so that upon a deflecting movement of the first spring plate 37, the second spring plate 43 can be carried along with the first spring plate. To limit the axial mobility of the second spring plate 43 counter to the force of the second restoring spring 42, the second spring plate 43 has a collar 46 extending in the axial direction, which after a predetermined compression of the second restoring spring 42 reaches a stationary stop.

The stepping motor 19' described in FIG. 3 has the advantage that as its active element it has a relatively simply structured electrical adjusting magnet 36, which if supplied with different current intensities can assume various intermediate positions as the current increases. In the illustrated example, a three-position stepping motor is realized; it is shown in its outset position here. When the adjusting magnet 36 is acted upon by a first current intensity, the armature and the bolt 35 are displaced to such an extent that the first spring plate 37 comes to rest on the second spring plate 43. Since the second restoring spring 42 is pre-stressed, a sudden increase in the restoring force thereby occurs, which can only be overcome by a magnetic force generated by a substantially higher current intensity. Subsequently, both spring plates are displaced together, until the second spring plate 43 comes to rest with its collar 46 against the stop attached to the housing. This then corresponds to the third position of the body 25. With this arrangement, three stable settings for the stop 14 can be attained in a simple manner, without undergoing great expense in terms of regulating technology. If a plurality of springs and a plurality of spring plates with stops are used, further subdivisions of the adjusting movement of the body 25 are attainable. While a pushing magnet has been shown in the exemplary embodiment of FIG. 3, a pulling magnet is provided in FIG. 5, and then the adjusting movement of the body 25' takes place in the opposite direction.

Figure 4:
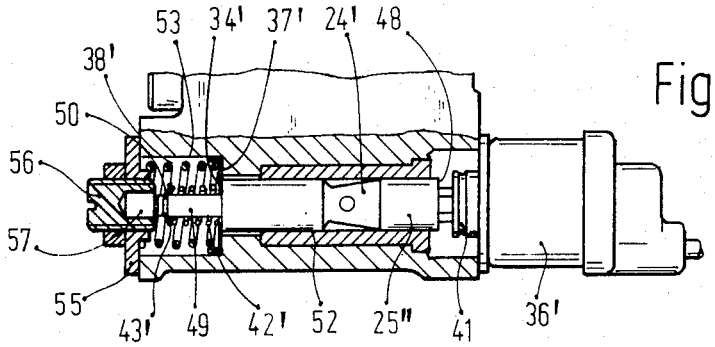
FIG. 4 shows a variant of the exemplary embodiment of FIG. 3.
Figure 6:
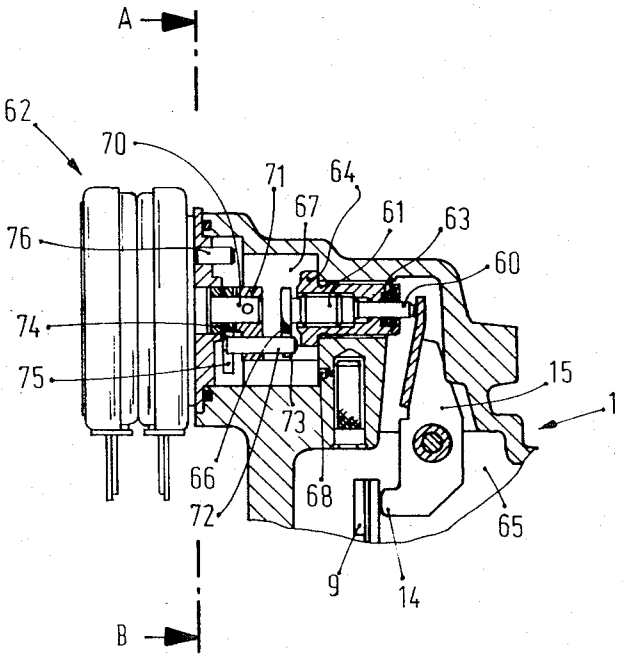
FIG. 6 shows a sixth exemplary embodiment of the invention having a rotary stepping motor.

FIG. 4 shows an embodiment in which the armature 41 of the adjusting manget 36' acts upon one end face 48 of the body 25'', which as in the exemplary embodiment of FIGS. 4 and 6 has a conical contour 24'. The body 25'' is displaceable in the longitudinal direction, as in the two foregoing exemplary embodiments, and on its other end face 34' it has a coaxially projecting tang 49, on the end of which a second spring plate 43' is disposed, between which and the end face 34' a second restoring spring 42' of small radius is fastened. The spring plate 43' is limited in its axial motion by a securing ring 50 on the tang 49.

In the initial position of the body 25'', the tang 49 protrudes into a cylinder 53, which, extending conically, adjoins the guide cylinder 52, which guides the body 25''. The cylinder 53 is closed at its end by a closure plate 55, into which a bolt 56 provided with a blind bore 57 is screwed. The blind bore 57 points into the interior of the cylinder 53 and has a diameter which is smaller than the outer diameter of the second spring plate 43, so that upon the intrusion of the tang 49 into the bore 57 the second spring plate 43 is raised up from the securing ring 50 and the second restoring spring 42' is compressed. The travel of the tang 49 is limited by the depth of the blind bore 57, or by the relative position of the bolt 56 with respect to the initial position of the body 25''.

A first spring plate 37′ also rests on the end face 34′, and a first restoring spring 38′ is fastened between this spring plate 37′ and the closure plate 55. In principle, this apparatus functions in the same manner as does the embodiment of FIG. 3. Upon a displacement of the body 25″ out of its outset position, this body is first moved counter to the force of the first restoring spring 38′, until the second spring plate 43′ comes to rest on the end face of the bolt 56. From this moment on, the pre-stressed second restoring spring 42′ additionally acts upon the body 25″, in fact until such time as the tang 49 finally meets the bottom of the blind bore 57. This apparatus has the further advantage over that shown in FIG. 4 that via the bolt 56 it is readily possible to establish specific graduated increments.

Alternatively to the embodiment of FIG. 4, the adjusting magnet is embodied as a pulling magnet, the armature of which engages a tang corresponding to tang 49 but with a longer length, and after a first adjusting path comes to rest on an adjustable spring capsule.

An apparatus having a stepping motor which can be dimensioned substantially more weakly is shown in the embodiment of FIG. 6. Here, as in the above-described exemplary embodiments, a flexing member 15 is again provided, on one lever arm of which the stop 14 for a magnetic adjusting device 9 is embodied. The other lever arm is engaged by a tang 60 of a threaded spindle 61, which acts as the adjusting device of a rotary stepping motor 62. The threaded spindle 61 is rotatably disposed inside a sleeve 64 threaded into the wall of the injection pump 1. The tang 60 projecting out of the sleeve 64 into the fuel-filled interior 65 of the fuel injection pump is sealed by a seal 63. On the side opposite the tang 60, the threaded spindle 61 has a crank 66, which protrudes into a chamber 67. This chamber is closed off toward the outside by the rotary stepping motor 62, which is flanged to the housing of the fuel injection pump. The chamber 67 can be flushed with a quantity of flushing fuel flowing out of the interior 65 of the fuel injection pump, so that moving parts disposed inside this chamber 67 can simultaneously be lubricated.

The rotary stepping motor has a shaft 70, with which a cam disc 71 is connected on the outermost end in a rotationally fixed manner. The shaft 70 is coaxial with the axis of the threaded spindle 61 and is coupled, via a coupling pin 72 inserted into the eccentric portion of the eccentric disc 71, with the threaded spindle 61 because of the engagement of the coupling pin 72 with an axially displaceable manner with a recess 73 of the crank 66. When the shaft 70 rotates, the threaded spindle 61 is thereby rotated as well via the tang 60, whereupon the threaded spindle 61 is capable of adjusting itself relative to the shaft 70.

A coupler disc 74 is also disposed on the shaft between the stepping motor 62 and the eccentric disc 71; this coupler disc 74 has a radially offstanding tang 75, which protrudes beyond the pivoting radius of the coupling tang 72 and is capable of being moved in coupled fashion by means of a portion of the coupling pin 72 protruding beyond the eccentric disc toward the stepping motor.

Figure 7:
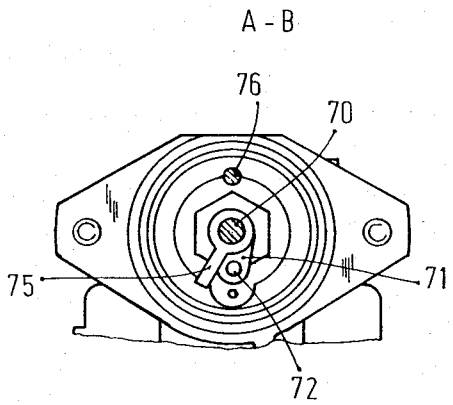
FIG. 7 is a view of a section taken through the exemplary embodiment of FIG. 6.

In the pivoting range of the tang 75, a stop attached to the housing is also provided, in the form of a pin 76 inserted into the end face of the stepping motor which closes off the chamber 67. The tang 75 can be made to rest against this pin 76 in the course of the rotational movement of the tang 75 about the axis of the shaft 70. The pin 76 is disposed outside the pivoting circle of the coupling pin 72, however, so that the coupling pin 72 is capable of moving unhindered past the pin 76. This disposition can be seen from the section taken through the exemplary embodiment of FIG. 6 and shown in FIG. 7.

With this apparatus, it is possible for the shaft of the stepping motor to execute virtually two complete revolutions before the further movement of the coupling pin 72 is blocked because the tang 75 of the coupler disc is located in front of the coupling pin 72 in the direction of rotation and comes to rest on the pin 76. This applies to rotation either clockwise or counterclockwise on the part of the shaft 70.

This apparatus has the advantage that the rotary stepping motor can execute a plurality of revolutions in order to establish desired positions of the adjustable stop 14. Thus the range of operation of the stepping motor is broadened considerably as compared with a realization in which only a cam which is rotatable in a fixed relationship with the shaft of the stepping motor is provided for adjusting the stop. If several coupler discs are provided instead of only one, and then one out of two or two out of three coupler discs each have to have coupler tangs which are radially offset from one another, the rotary stepping motor can also execute more than two revolutions. Thus the embodiment according to the invention permits the use of very small rotary stepping motors and guarantees both a very precise adjustment and a very finely graduated adjustment of the position of the stop 14.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump including a housing, a lever pivotable about a fixed axis in said housing, a stop on one end of said lever which limits the movement of a quantity adjusting device actuatable counter to a spring force, a stepping motor for actuating said lever, said stepping motor is embodied as a linear stepping motor, with which at least one end stop is associated, and includes a lever adjusting device which pivots said lever about said fixed axis for adjusting the movement of said quantity adjusting device, said stepping motor includes a magnetic coil and an armature which is acted upon by a first restoring spring supported in a stationary manner and which armature is adjustable counter to the force of said first restoring spring in accordance with at least one defined adjusting path and further adjustable counter to the force of at least one pre-stressed additional restoring spring in accordance with another defined adjusting path subsequent to said at least one defined adjusting path.

2. A fuel injection pump as defined by claim 1, in which said lever adjusting device includes an adjustable body including a jacket face which has a scanning curve profiled in an adjusting direction, which scanning curve is scannable by means of a scanning device disposed between the adjustable body and said lever in order to adjust said stop.

3. A fuel injection pump as defined by claim 2, in which the jacket face of the adjustable body in the scanning region is conical.

4. A fuel injection pump including a housing, a lever pivotable about a fixed axis in said housing, a stop on one end of said lever which limits the movement of a quantity adjusting device actuatable counter to a spring force, a stepping motor for actuating said lever, said stepping motor is embodied as a rotary stepping motor and includes a lever adjusting device which pivots said lever about a fixed axis for adjusting the movement of said quantity adjusting device, said rotary stepping motor includes a threaded spindle adjusting device which has a coupler part which is eccentrically engaged in a rotationally fixed manner by a coupling tang which is connected with a shaft of the rotary stepping motor.

5. A fuel injection pump as defined by claim 4, in which at least one drag member is disposed on the shaft of the rotary stepping motor, and the drag body having a radially outstanding tang protruding into a pivoting circle of said coupling tang, and the drag body is operable by said coupling tang to contact with an end stop disposed in a stationary fashion outside the pivoting circle of the coupling tang.

6. A fuel injection pump as defined by claim 5, in which a plurality of drag bodies is disposed axially one after the other on the shaft, which drag bodies can be coupled with one another via coupler tangs each time after one revolution of the next drag body in a sequence.

7. A fuel injection pump as defined by claim 1, in which a lever adjusting device is adjustable to a desired control value by a control device wherein upon each required adjustment, the adjusting device is forced to a reference point in which subsequent to being forced to a reference point, an adjustment of the lever adjusting device corresponding to a new control value is performed.

8. A fuel injection pump as defined by claim 2, in which the lever adjusting device is adjustable to a desired control value by a control device wherein upon each required adjustment, the adjusting device is forced to a reference point in which subsequent to being forced to a reference point, an adjustment of the lever adjusting device corresponding to a new control value is performed.

9. A fuel injection pump as defined by claim 3, in which the lever adjusting device is adjustable to a desired control value by a control device wherein upon each required adjustment, the adjusting device is forced to a reference point in which subsequent to being forced to a reference point, an adjustment of the lever adjusting device corresponding to a new control value is performed.

10. A fuel injection pump as defined by claim 1, in which the lever adjusting device is adjustable to a desired control value by a control device wherein upon each required adjustment, the adjusting device is forced to a reference point in which subsequent to being forced to a reference point, an adjustment of the lever adjusting device corresponding to a new control value is performed.

11. A fuel injection pump as defined by claim 4, in which the lever adjusting device is adjustable to a desired control value by a control device wherein upon each required adjustment, the adjusting device is forced to a reference point in which subsequent to being forced to a reference point, an adjustment of the lever adjusting device corresponding to a new control value is performed.

* * * * *